US005765267A

United States Patent [19]

Ebbinghaus

[11] Patent Number: 5,765,267

[45] Date of Patent: Jun. 16, 1998

[54] SINGEING MACHINE

[75] Inventor: Rainer Ebbinghaus, Mönchengladbach, Germany

[73] Assignee: Osthoff-Senge GmbH & Co. KG, Wuppertal, Germany

[21] Appl. No.: 706,330

[22] Filed: Aug. 30, 1996

[51] Int. Cl.[6] ..... D06C 9/02

[52] U.S. Cl. ..... 26/3

[58] Field of Search ..... 26/3, 4, 5, 99, 26/18.5, 18.6; 28/165, 116, 122, 134; 432/8, 59

[56] References Cited

U.S. PATENT DOCUMENTS

| | | | |
|---|---|---|---|
| 1,350,582 | 8/1920 | Whitaker | 26/3 |
| 1,988,554 | 1/1935 | Hall | 26/3 |
| 2,410,542 | 11/1946 | Kemp | 26/3 |
| 3,134,158 | 5/1964 | Marks, Jr. | 26/3 |
| 3,721,517 | 3/1973 | Osthoff | 432/8 |
| 3,837,051 | 9/1974 | Osthoff et al. | 26/3 |
| 3,984,198 | 10/1976 | Birke et al. | 432/59 |
| 4,332,063 | 6/1982 | Ehrhardt | 26/3 |
| 4,475,417 | 10/1984 | Dornier | 26/3 |
| 4,611,370 | 9/1986 | Sando et al. | 26/3 |
| 4,627,135 | 12/1986 | Osthoff | 26/3 |
| 4,641,403 | 2/1987 | Osthoff et al. | 26/3 |
| 4,794,677 | 1/1989 | Strudel | 26/3 |

FOREIGN PATENT DOCUMENTS

| | | | |
|---|---|---|---|
| 2213631 | 10/1973 | Germany . | |
| 4125778 | 2/1993 | Germany . | |
| 29505376 | 8/1996 | Germany . | |
| 636299 | 12/1978 | U.S.S.R. | 26/3 |
| 1516551 | 10/1989 | U.S.S.R. | 26/3 |

*Primary Examiner*—Amy B. Vanatta
*Attorney, Agent, or Firm*—Martin A. Farber

[57] ABSTRACT

A singeing machine, especially for the flame treatment of carpets made in the tufting process, with a burner unit (3) and disposed downstream of the burner unit (3) a smooth roller (14) which has a moistened surface (15), and which smooth roller (14) is cooled, wherein the smooth roller (14) is so strongly cooled that its surface (15) is below the dew point.

8 Claims, 3 Drawing Sheets

SINGEING MACHINE

FIELD AND BACKGROUND OF THE INVENTION

The invention relates to a singeing machine, especially for the flame treatment of carpets made by the tufting method, with a burner unit and a smooth roller downstream thereof, the latter having a moistened surface, and being cooled.

A singeing machine of this type is known from DE-OS 41 25 778. The surface of said smooth roller is kept wet by a moisturiser installed above it. The smooth roller together with a guide roller disposed below it forms a squeezing mechanism which acts on the tufted carpet web drawn through the roller gap. The guide roller functions simultaneously as a deflector and a guiding face against which the burner unit can be directed. The singeing flame is directed toward the centre of the guide roller, in the relevant working position.

It is known from DE-PS 22 13 631 to form the deflecting and guiding edge from a kind of tabletop edge instead of a guide roller. The tabletop edge is acute-angled, but its apex is convexly rounded and has an air channel located approximately in the angle bisector, flanked by cooling water channels.

SUMMARY OF THE INVENTION

It is an object of the invention to develop a singeing machine of the type described which is improved in regard to the manner of cooling the smooth roller and the method of moisturising.

For this purpose it is first proposed that the smooth roller is so strongly cooled as to produce on its surface a temperature below the dew point. A self-moisturiser, as it were, is thus realised and with the simplest means. The surface of the smooth roller, thus continuously kept moist, prevents the adhesion thereto of thermally responsive parts of the tufted carpet web. Alongside this basic form of moistening, considered as a minimal security measure, additional moisteners of conventional construction can be used, according to the needs and properties of the product passing therethrough. An advantageous further feature is that the smooth roller is arranged substantially in an extension of the stream of gas emerging from the burner unit. The gas stream which forms the singeing flame even has an additional property acting in support of the moisturising, since the water component entrained in the gas likewise condenses on the smooth roller as moisture. The effectiveness of the protection against adhesion is thereby further improved. In order to avoid over-heating in the region of the squeezing mechanism, it is proposed that a flame baffle be disposed in the gas stream in front of the smooth roller. It acts with respect to the smooth roller as a heat shield, so that the moisture which is generated (and on occasions additionally supplied) is not depleted so rapidly or can continuously renew or supplement itself as the case may be. It is here useful if the flame baffle itself undergoes cooling, which is achieved by means of a flat tube through which water flows. Such a slab-shaped flat tube can comprise a slot for the passage of the tufted carpet web; but a portal construction is also conceivable and advantageous. Moreover there is an additional refrigeration feature of the invention in this, namely that the smooth roller has a cooling current directed at the outer surface of the roller and oriented in the direction of the roller bearings. The medium which has thus swept through the interior of the roller and emerged again at both ends thereof is conveyed to a refrigeration apparatus and fed in once more to the flowpath. Here it proves to be advantageous that the smooth roller should have a substantially central feed current directed oppositely to the cooling current. The central infeed at both ends lead to a balanced distribution of the cooling medium, and results in uniform cooling and moisturising. It is of further advantage that cooling and feed currents in the respective inlet and outlet regions should be disposed as substantially concentric counter-currents. Finally there is a further advantageous feature of the invention in that an acute-angled deflector/guide edge is formed between the gas current and the flame baffle, with a cooling pipe which lies in the apex of the angle. This leads to a practically sword-shaped tabletop edge in the singeing station.

BRIEF DESCRIPTION OF THE DRAWINGS

With the above and other objects and other advantages in view, the present invention will become more clearly understood in connection with the detailed description of a preferred embodiment, when considered with the accompanying drawings of which FIG. 1 the singeing machine seen in full width.

DETAILED DESCRIPTION OF THE PREFERRED EMBODIMENT

Figure 1:
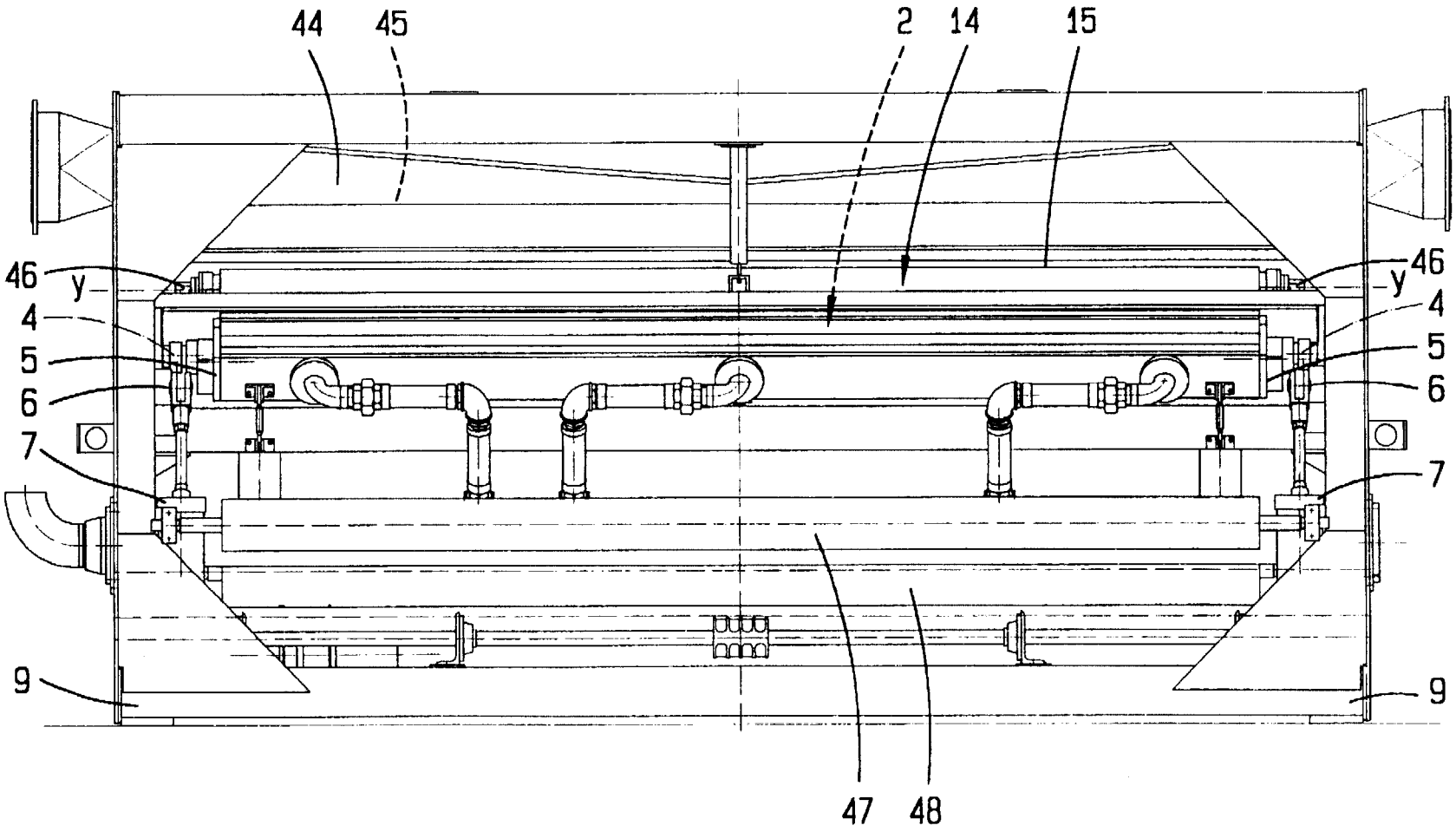

The singeing machine illustrated serves for the flame treatment of carpets manufactured by the tufting process. They pass in the form of a tufted carpet web 1 through a singeing station of the machine represented as a whole by 2.

The object of the treatment may correspond to that of the cited DE-OS 41 25 778. The relevant descriptive passages therein are incorporated herein by reference.

The heart of the singeing station 2 is a burner unit 3. It is a long burner which extends over the entire width of the singeing machine, which has a width of about 5 m. Details of a burner unit of this type are disclosed in the German Utility Model 29 505 376. These details also can be referred to in the interest of a well-rounded appreciation.

The burner unit 3 can be swivelled about a horizontal pivotal axis 4 between a switched off and a working position. The pivoting device in question includes a swivel arm 5. The latter is connected to a power cylinder 7 by way of an articulation point 6. The cylinder addresses 5 at an angle. Its lower end is supported on the machine chassis 9 by way of an articulation point 8. The power cylinder 7 swivels about the articulation point 8. This can be an eccentrically mounted device.

The burner unit 3 has a burner slot 10. A stream of gas emerges from this slot. The stream forms an emerging, directed singeing flame 11.

The burner slot 10 is produced by adjacent placement of two angle blocks 12, 13 of the burner unit 3, which form the slot between them. The width and profile of the slot can be varied by means of at least one angle block which can be displaced and securely fixed.

Figure 2:
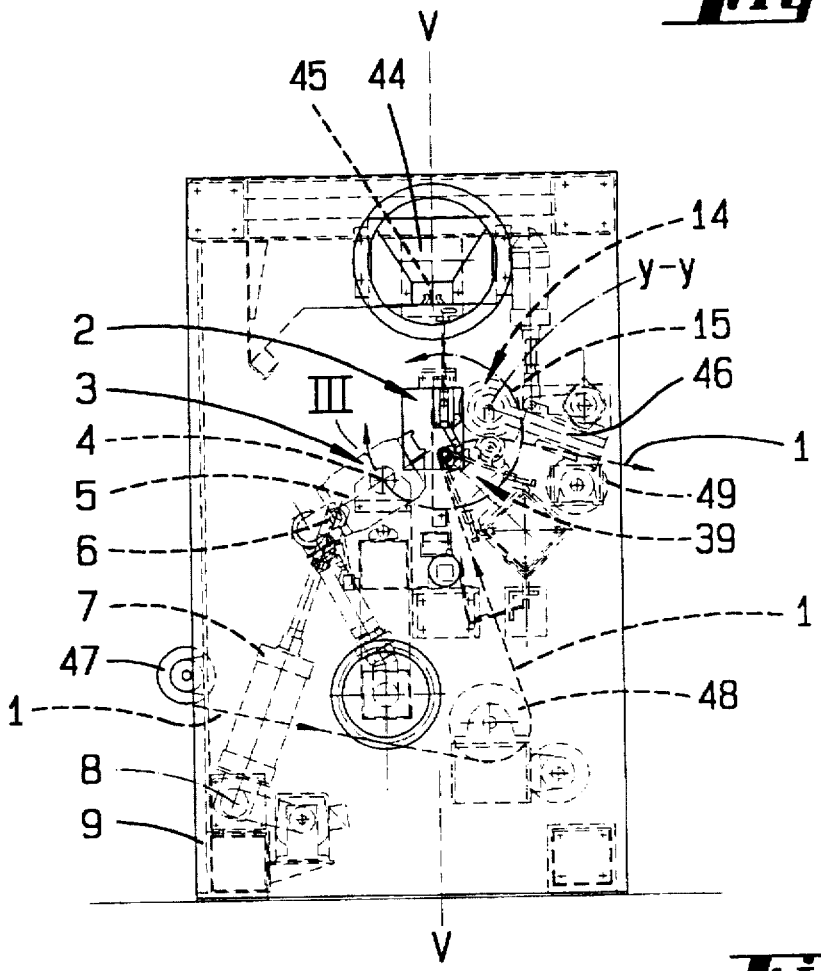
FIG. 2 is the same in side view.
Figure 3:
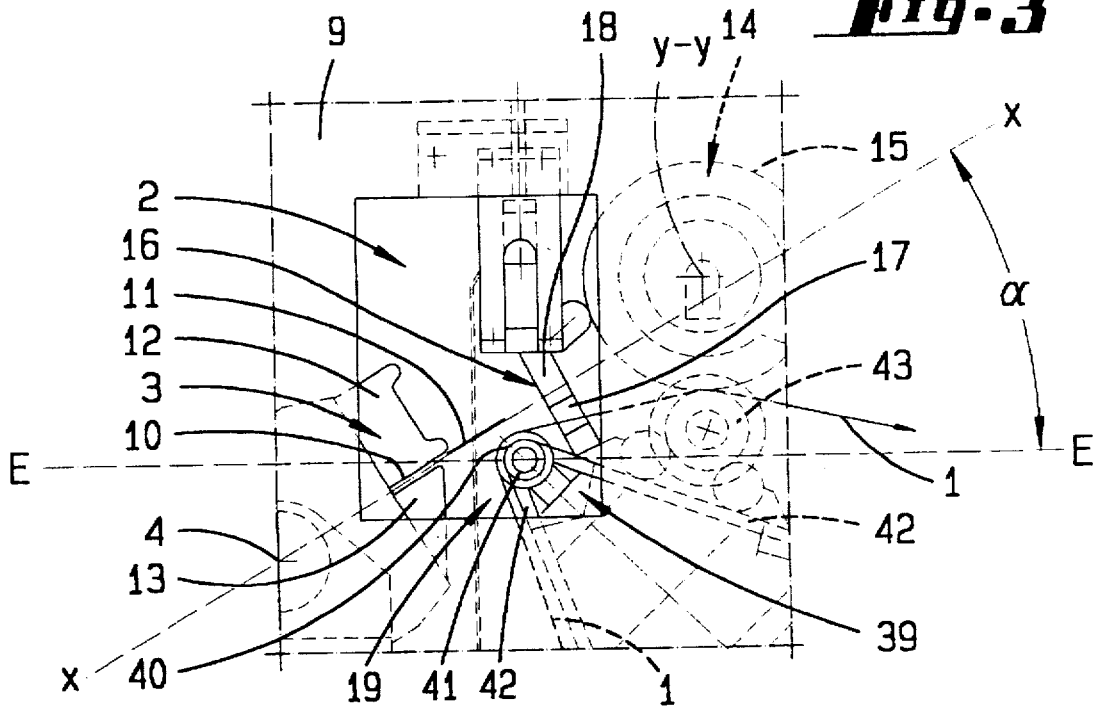
FIG. 3 is an enlarged detail therefrom designated III.

FIGS. 2 and 3 show the burner unit 3 in the working position, according to which the burner slot 10 adopts an inclined orientation rising to the right at an angle alpha of about 30° to a horizontal plane E—E of the singeing machine.

A smooth roller 14 lies downstream of the burner unit 3 in this upwardly inclined direction. Its surface 15 is kept moistened. The smooth roller 14 is cooled for this purpose. The cooling takes place from the interior of the smooth roller 14 which is of a hollow construction for reception of the necessary cooling medium.

The cooling is so adjusted that the surface 15 of the smooth roller 14 is at a temperature below the dew point. This is important, since the smooth roller 14, functioning as a compression roller, must always have a certain degree of moistness, in order to prevent the tufted carpet web 1 on the smooth roller 14 which lies in the singeing station 2, and therefore becomes slightly warmed up, from partially adhering or even sticking fast thereto. Practice shows that thermally responsive parts possess a tendency to adhesive bonding. Some constructions of the backing of the carpet web 1 can display this property also. The layer of moisture lying in between has a reliable separating counter-effect.

The arrangement of the smooth roller 14 is such that it is disposed substantially in the prolongation and therefore in the working area of the gas stream coming from the burner unit 3, and thus of the singeing flame 11. As a result the water component entrained in the gas current is deflected into the region of the smooth roller 14 downstream thereof. The moisture which condenses on the surface 15 of the smooth roller 14 as a result of the mentioned dew-point effect is further augmented by the free hydrogen which arises from the use of gas as fuel, combines with $H_2O$ and likewise condenses as moisture on the smooth roller.

The prolongation is identifiable from the upper line x—x which helps to define the angle alpha. The geometrically horizontal axis y—y of the smooth roller 14 lies slightly above the said broken line. The upper line x—x and the horizontal plane E—E intersect in front of the mouth of the burner slot 10, forming there the apex of the angle alpha.

A flame baffle 16 is located in the gas current upstream of the smooth roller 14. The flame baffle 16 prevents direct flame treatment of the surface 15 of the smooth roller 14. At the same time it functions as a heat shield. As can be seen particularly clearly from FIG. 3, the flame baffle 16, which is constructed as a flat tube, extends substantially transversely in front of the singeing flame 11, i.e. the longer axis of the cross-section of the flame baffle 16 extends approximately perpendicularly to the upper line x—x. The latter crosses essentially in the centre of the flame baffle 16.

The product travelling in the direction of the arrow shown, i.e. the tufted carpet web 1, passes through the flame baffle 16. For this purpose the flame baffle 16 has a passage slot 17. The latter begins slightly below the mentioned mid-point. One such passage slot 17 additionally can open at the lower narrow side of the flame baffle 16, so that it is more of a portal-like body that is present as a flame baffle 16.

The flame baffle 16, too, is provided with means for cooling it. Water flows through it. The cavity 18 required for this arises from the use of a flat tube.

The cavity 18, which is interrupted by the passage slot 17, can be connected for water flow at its end regions, that is to say at the end parts of the flame baffle 16, which lie outside the width of the product, and can additionally be used for mounting purposes. A swivel mounting can be the basis for this, so that the steeply rising orientation of the flame baffle 16, from bottom right to top left as seen in FIG. 3, can also be varied to a limited extent.

As can be gathered further from FIG. 3, the singeing flame 11 sweeps evenly and tangentially across a convex guide point 19 of the pathway 1 of the tufted carpet.

The cooling system of the smooth roller 14, in principle, arises from the provision for the smooth roller 14 of a cooling current applied to the outer surface of the roller and then directed more, and increasingly, in the direction of roller bearing 20. The cooling current is labelled "a", its more radial branching "a'", and is indicated by arrows pointing in the flow direction.

The smooth roller 14, made from a tubular cylinder 21, is closed around the roller bearing 20 by annular end walls 22. Only the left-hand part is fully represented in FIG. 4, the right-hand part is a mirror-image thereof.

A stub axle 23 which forms part of the mounting 20 of the roller is welded on its outer wall to the end wall 22. It projects significantly beyond said end wall 22, centrally into a hollow section 24 of the smooth roller 14. That end of the stub axle 23 penetrates a similarly annular inner wall 25 of the smooth roller 14, and is likewise secured here by welding.

A cylindrical shell section 26 extends then from that end of the inner wall 25 which is opposite to the roller mounting 20. Its outside diameter is markedly smaller than the internal diameter of the hollow cylinder 21, so that an annular channel 27 remains capable of conducting a flow. This forms a part of the path of the cooling current a.

So as to provide access to the hollow section 24, the inner wall 25 bears peripheral grooves, leaving overflow recesses 28 which lead to the hollow interior of the smooth roller 14.

The stub axle 23 is hollow along its full length. The corresponding bore bears the reference numeral 29. The latter accommodates a pipe 30, through which the cylinder interior 31 is fed with cooling medium, especially cooling fluid, for example water. The shell section 26 which carries a flow over its outer wall has its whole length on the inside hydrodynamically isolated. That is to say, its end that faces the interior 31 of the cylinder is closed off by an end wall 32, likewise of an annular disc form. This section, as to its inner shell wall, is hydrodynamically by-passed by a by-pass pipe 33. The latter is secured in a central through perforation of the said end wall 32, also by welding. The roller mounting end of the by-pass pipe 33, on the other hand, is lodged in a central recess 34 of the adjacent end of the stub axle 23 which runs right through the hollow space section 24.

The pipe 30 is firmly secured in a central bore 34 from which a connecting channel 35 (approximately the inner cross-section of the pipe 30) communicates with the by-pass pipe 33. The bore 34 is a continuation of the bore 29 with a reduced cross-section.

In the region where the hollow space section 24 forms, as it were, an intermediate chamber, the stub axle 23 also comprises transverse bores 36 which lie within the extent of its own bore 29. These connect the fluid pathway a with an annular space 37 which is present because of an appropriate difference in cross-section between the bore 29 and the outer diameter of the pipe 30. The annular space 37 forms the exit region A of the cooling current a of the cooling system, while the pipe 30 forms the entry region E of the same. The feed flow b is likewise indicated by arrows which show its direction.

Thus, taken together, we have a substantially central feed current b, directed oppositely to the cooling current a, and the cooling current a and feed current b are arranged in the input region E or output region A as substantially concentric counter-currents.

The feed system is identical at both ends of the smooth roller 14. In the interior 31 of the cylinder there is a well-mixing confluence of both current systems a, b and a, b.

Figure 4:
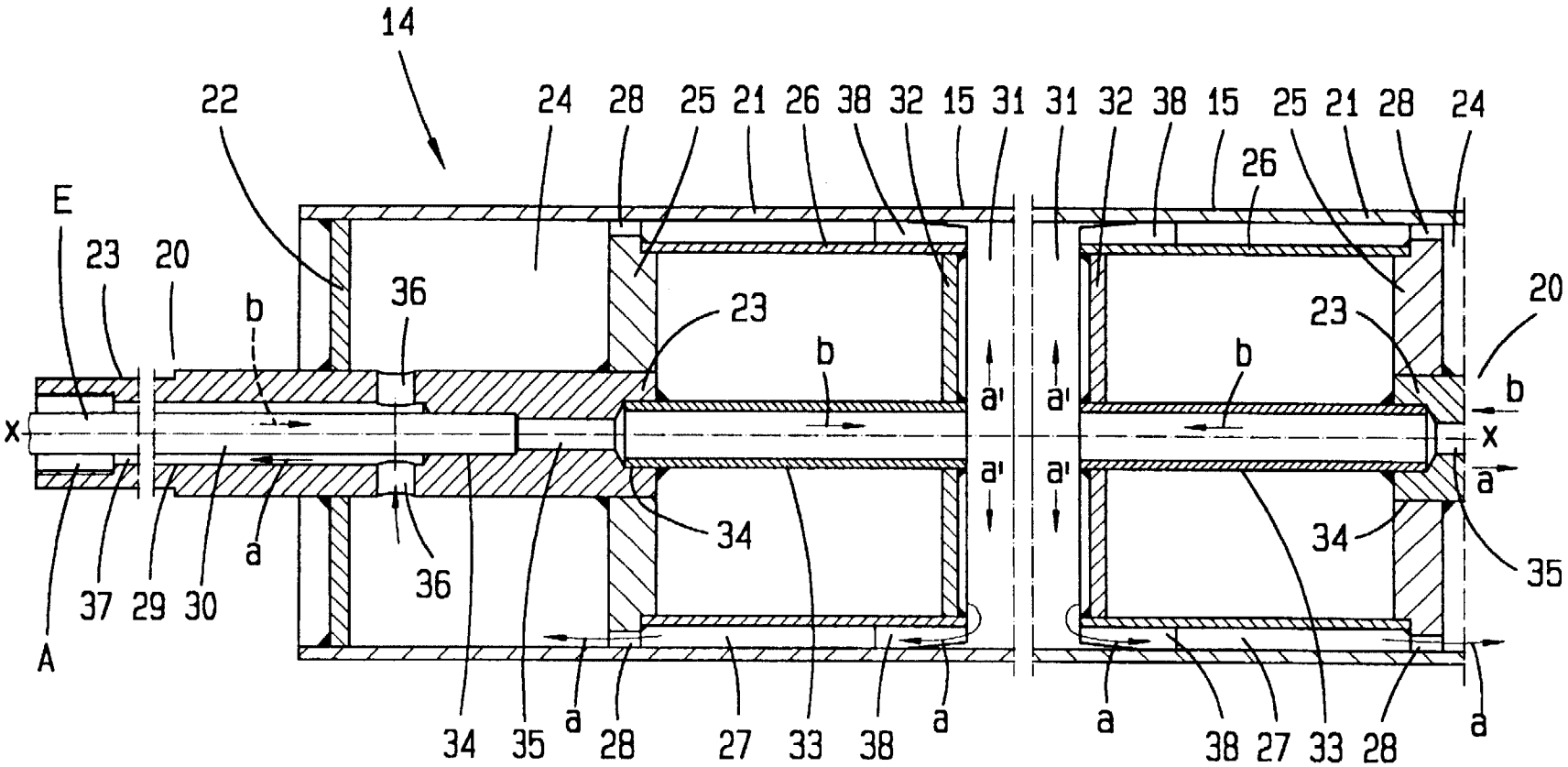
FIG. 4 is a longitudinal section of the smooth roller illustrated separately.

As can be further seen from FIG. 4, an arrangement of wedge pieces 38 which taper towards one another are securely associated with the outer wall of the cylindrical shell section 26. These hold the inner wall 25, which would otherwise float freely relative thereto, against misalignment during assembly and in operation, so that the roller bearings 20 adopt an axially identical orientation to the geometrical axis x—x of the smooth roller 14. Advantageously three wedge pieces 38 are provided as spacers, and they have an equiangular distribution and a centering effect on insertion.

The input and output regions E and A lead to a refrigeration apparatus which is not shown.

With regard to the guide point 19 it remains to explain that this is formed from an acute-angled block 39, which extends spatially parallel to the smooth roller 14 and lies below the latter with a vertical spacing apart. More particularly it lies in the directionally indicated pathway between the gas current, (or singeing flame 11) and the flame baffle 16. The block 39 there forms a deflecting or guiding edge 40, whose angular apex which faces the singeing station 2 acquires a helpful deflecting curvature from the use of a pipe. Advantageously it is a pipe 41 of round cross-section. This has the advantage that the pipe interior 42 can be used as a cooling member by passage of a suitable cooling medium therethrough, so that the pipe is to be designated cooling pipe 41.

The blade or sword shape of the block 39, which is particularly clearly illustrated in FIG. 3, arises from the tangential approach of two metal guide sheets 42. They enclose between them an angle of about 50° in the direction away from the singeing station 2. Mountings and conveying means can be accommodated in the annular space.

Between the upper guiding sheet 42 and the underside of the smooth roller 14 lies a guide roller 43 arranged axially parallel to the latter. This, together with the smooth roller 14, constitutes a squeezing mechanism, through the substantially horizontally oriented rolling slot of which the web 1 of tufted carpet passes. The lower roller, designated guide roller 43, of the calender roller pair thus realised, is markedly smaller in diameter than the diameter of the smooth roller 14. The latter has a diameter about double that of the guide roller 43.

A suction device, generally designated 44, is located above the singeing station 2. Its downwardly open suction nozzle 45 extends in the vertical direction above the region between the mouth of the burner slot 10 and the guide point 19.

Displacement and securing of the smooth roller 14 with respect to the guide roller 43 or vice versa is based on a suitable mounting, for example with the use of mounting arms 46.

Further guide rollers 47, 48 as well as a support roller 49 which adjoins the right hand side of the guide roller 43, give the web 1 of tufted carpet an essentially S-shaped guided pathway. The singeing station 2 lies in the transition region of the S-bridge to the upper limb of the S. The S-bridge extends at an acute angle (c. 20°) to a vertical line V—V which approximately divides the guide point 19 and the suction nozzle 45.

I claim:

1. A singeing machine, suitable for flame treatment of carpets made by a tufting process, the machine comprising a burner unit and a smooth roller disposed downstream of a gas stream produced by the burner unit, the smooth roller having a moistened surface, and wherein a surface of the smooth roller has a temperature below the dew point.

2. A singeing machine according to claim 1, wherein the smooth roller is located substantially along an axis of the gas stream emerging from the burner unit.

3. A singeing machine according to claim 2, further comprising a flame baffle disposed in the gas stream, upstream of the smooth roller.

4. A singeing machine according to claim 3, wherein the flame baffle comprises a flat tube through which water flows.

5. A singeing machine according to claim 1, wherein the smooth roller comprises a passage for flow of a cooling medium, the passage directing the flow towards an outer roller surface of the smooth roller and towards bearings of the roller.

6. A singeing machine according to claim 5, wherein the passage is a first passage, and the smooth roller comprises a second passage for flow of the cooling medium via a substantially central feed flow directed oppositely to the flow direction of the medium in the first passage.

7. A singeing machine according to claim 6, wherein the smooth roller has an inlet region communicating rating with the first passage and an outlet region communicating with the second passage; and the flow of cooling medium in the first passage and the flow of cooling medium in the second passage are substantially concentric counter-flows in the inlet and the outlet regions of the smooth roller.

8. A singeing machine according to claim 3, further comprising a guide with an apex facing the gas stream for guiding a carpet past the gas stream, the apex having sidewalls angled to each other at an acuate angle, the apex being positioned between the gas stream and the flame baffle, the guide comprising a cooling pipe lying in the apex.

* * * * *